US009663279B2

(12) United States Patent
Roesler

(10) Patent No.: US 9,663,279 B2
(45) Date of Patent: May 30, 2017

(54) FLEXIBLE SAFETY CAP FOR ACCOMMODATING SHAFTS OF DIFFERENT DIAMETERS

(71) Applicant: Peter Roesler, Wangen (DE)

(72) Inventor: Peter Roesler, Wangen (DE)

(73) Assignee: Rose Plastic AG (DE)

( * ) Notice: Subject to any disclaimer, the term of this patent is extended or adjusted under 35 U.S.C. 154(b) by 0 days.

(21) Appl. No.: 14/508,530

(22) Filed: Oct. 7, 2014

(65) Prior Publication Data

US 2015/0101721 A1 Apr. 16, 2015

(30) Foreign Application Priority Data

Oct. 16, 2013 (DE) ..... 10 2013 017 140

(51) Int. Cl.
*B65D 59/06* (2006.01)
*B25H 3/00* (2006.01)

(52) U.S. Cl.
CPC ..... *B65D 59/06* (2013.01); *B25H 3/00* (2013.01)

(58) Field of Classification Search
CPC ..... B65D 59/06
USPC ..... 206/363, 365, 379, 349, 443; 150/161, 150/154; 220/287
See application file for complete search history.

(56) References Cited

U.S. PATENT DOCUMENTS 4,061,226 A * 12/1977 Essen ..... G01K 1/083 206/212
4,984,793 A * 1/1991 Chen ..... A63B 49/08 473/519
5,158,550 A * 10/1992 Scholl, Jr. ..... A61M 5/002 604/110
5,334,162 A * 8/1994 Harris ..... A61J 1/062 604/232
5,520,193 A * 5/1996 Suzuki ..... A61B 5/1422 600/577
5,595,294 A * 1/1997 McKenzie ..... B25H 3/021 206/349
5,979,649 A * 11/1999 Rosler ..... B65D 25/10 206/349
8,448,782 B2 * 5/2013 Chin ..... A45C 11/20 206/217
2005/0054987 A1 * 3/2005 Perez ..... A61M 5/3271 604/198

(Continued)

FOREIGN PATENT DOCUMENTS

DE 8810820 10/1988
DE 9115564 4/1993
DE 19517519 11/1996

(Continued)

*Primary Examiner* — Sue A Weaver
(74) *Attorney, Agent, or Firm* — Cohen & Grigsby, P.C.

(57) ABSTRACT

A flexible safety cap (1) for accommodating any tool (13, 14) among a group of tools having different diameters or different geometries, said cap having a terminating front wall (10) and an oppositely disposed clamping opening (8, 8') with at least one non-round, acting clamping profile (5, 5', 5'', 5''', 5'''') wherein at least one slot (9) that penetrates through the wall of the safety cap (1) is disposed in the vicinity of the front wall (10) to establish an elastic, resilient clamping connection between an outside circumference of the tool (13, 14) and an inside wall of the safety cap (1).

19 Claims, 4 Drawing Sheets

(56) References Cited

U.S. PATENT DOCUMENTS

2013/0172819 A1* 7/2013 Iio ..... A61M 5/20
604/111

FOREIGN PATENT DOCUMENTS

| | | | |
|---|---|---|---|
| DE | 29721437 | U1 | 2/1999 |
| DE | 202011004197 | U1 | 8/2011 |
| EP | 0693436 | | 1/1996 |
| EP | 0841259 | | 5/1998 |

* cited by examiner

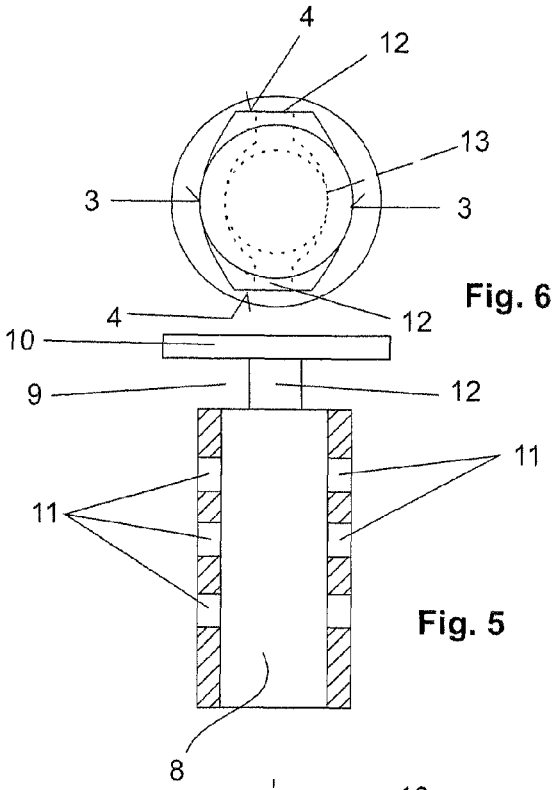
Fig. 6
Fig. 5
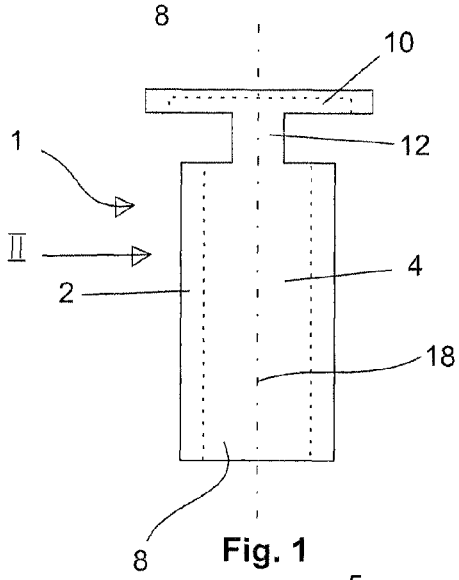
Fig. 1
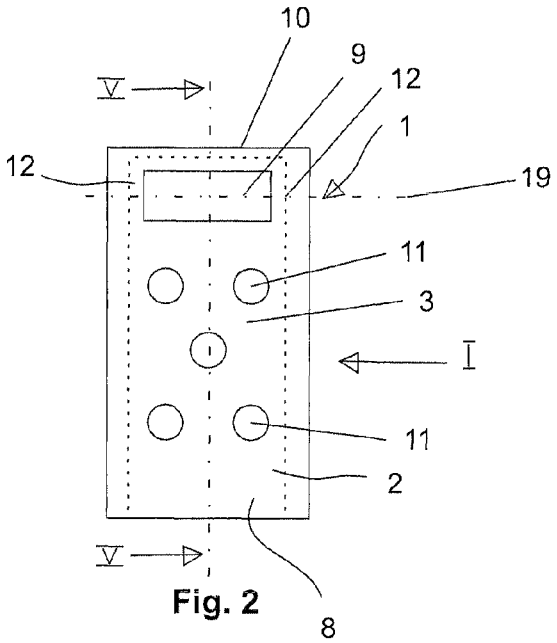
Fig. 2
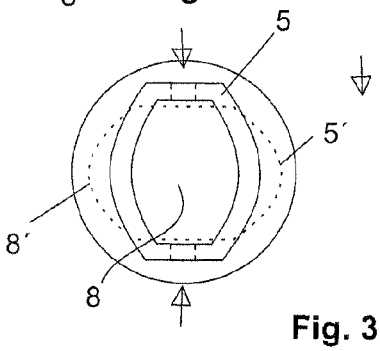
Fig. 3
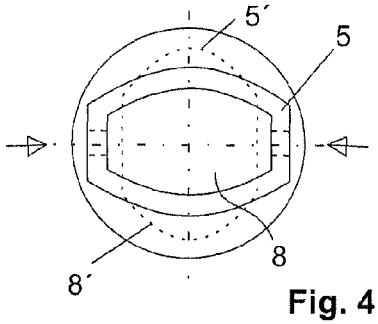
Fig. 4

FLEXIBLE SAFETY CAP FOR ACCOMMODATING SHAFTS OF DIFFERENT DIAMETERS

BACKGROUND OF THE INVENTION

Field of the Invention

The invention relates to a flexible safety cap for accommodating tool shafts or other objects of different diameters wherein the safety cap includes a terminating front wall and an oppositely disposed clamping opening. The flexible safety cap has at least one acting clamping profile to establish a clamping connection between an outside circumference of the tool and an inside wall of the safety cap.

Discussion of the Prior Art

Cup-shaped safety caps made of a plastic material having a relatively low intrinsic elasticity are known from the prior art. On one end, the cup-shaped safety cap, according to the prior art, forms a clamping opening into which a shaft of a tool can be inserted.

According to the prior art, the cup-shaped safety cap has a cylindrical cross section so, consequently, the clamping opening also has a cylindrical shape. There is, therefore, the disadvantage that shafts of different diameters can be accommodated to a very limited extent because of the low intrinsic elasticity of the known safety cap.

By way of example, in the prior art a tool shaft which may be embodied as a drill tip, as a drill bit, as an awl or the like may be reliably clamped; reliably only in the range of approx. 10 to 11 mm for a safety cap diameter of 10 mm. If shafts of a larger diameter are to be inserted and clamped in a safety cap of such dimensions, there is the disadvantage that the shafts will contact the inside wall of the safety cap with a high level of friction. This creates a risk that, when the tool shaft is pulled out of the safety cap, abrasion particles from the inside wall of the safety cap might be entrained with the shaft while it is being extracted. When such a known safety cap is used for packaging surgical tools and instruments, such abrasion has unwanted consequences if particles are entrained when the tool is extracted with a suitably shaped blade or tip design, because these particles inadvertently enter the surgical field.

The known safety cap according to the prior art has low intrinsic elasticity due to the circular or rotationally symmetrical geometry of a cup shape, so that only shafts with a diameter that is only slightly different from the diameter of the safety cap can be reliably clamped.

Handling of such a safety cap is difficult because it is also difficult to remove the safety cap from the tool tip if there is a reliable degree of clamping. A compressive force may be applied by finger pressure to the side walls of the safety cap to apply a tensile force to the safety cap, but this also can cause tightening of a clamping connection between the inside wall of the safety cap and the outside circumference of the tool. The clamping is thus increased in an undesirable manner during extraction of the tool. This results in an even greater risk of particles being abraded from the inside wall of the safety cap and entrained with the tool being extracted.

Clamping is neither possible nor provided for small diameters to be clamped, such as, for example, those existing with syringes that are surrounded by a sleeve-shaped safety cap. When such a sensitive syringe tip is released from the safety cap, there is a high risk of damage to the tip or the blade connected to the tip.

Consequently, a cup-shaped safety cap according to the prior art has the disadvantage that it cannot and must not be used for clamping surgical instruments and objects due to the risk of entrainment of particles from the inside wall of the safety cap.

SUMMARY OF THE INVENTION

The object of the invention is an improvement on safety caps of the prior art so that various tool shafts with a wide range of diameters, optionally with variously shaped blades and tips disposed thereon, may be clamped while avoiding the risk that particles will be entrained from the safety cap as the tool is extracted from the safety cap.

To solve such problems, an embodiment of the present invention includes a safety cap that has a clamping profile that is non-round and that has at least one slot that is located adjacent to the front wall of the safety cap and that penetrates through the wall of the safety cap.

One feature of the invention is that the safety cap has a profile shape, for example, in the shape of an ellipse or a rectangle that is different from a circular or rotationally symmetrical profile. In an embodiment, the profile has a wide side with a greater length or perimeter extent than a narrow side that has a lesser perimeter extent. The narrow side is attached to the wide side at an angle to form a non-circular clamping profile that is different from the cylindrical shape. In this way, the longitudinal side of the clamping part has a greater length or perimeter extent than the perimeter extent of the narrow side.

Furthermore, a slot that perforates the wall of the safety cap is disposed adjacent the front wall that terminates the cup-shaped safety cap. The technical teaching described here yields the essential advantage that the elasticity of the side walls of the safety cap is now independent of the elasticity of the front wall that terminates the wall of the safety cap due to a slot that interrupts the wall of the safety cap in the upper region of the safety cap.

The slot thus decouples the clamping walls of the safety cap from the front wall that terminates the cup in the manner of a bottom wall or a front wall. In an embodiment, the front wall has at least the diameter of the object to be clamped.

This is an important advantage in comparison with the prior art because previously in the prior art there was a low elasticity due to the circular or rotationally symmetrical profile shape of the safety cap.

This is avoided with the present invention in that the presently disclosed invention deviates from the rotationally-symmetrical profile shape of the clamping profile. Instead, the presently disclosed invention includes an elongated elliptical or rectangular or acute angle clamping profile that deviates from the circular or rotational shape such that the ratio of the length of the wide wall, or major dimension of the clamping opening of the clamping part to the width of the narrow wall or minor dimension of the clamping opening of the clamping part is in a different ratio.

For example, the length of the wide wall or major dimension may be in a ratio of 2:1 in relation to the length of the narrow side or minor dimension.

Any other length ratio to width ratio that ensures that the length of the wide wall is greater than the length of the narrow wall of the clamping profile is possible. Thus, for example, diameter ratios of 2:1.5 or 2:1.1 or 2:1.8 or the like may also be used.

With the non-round profile shape, which is preferably designed to be elliptical or rectangular, it is important that finger pressure from one hand can press on two opposing narrow walls to cause the entire safety cap to deform so that a clamping wall that has an elliptical or rectangular clamping profile in a natural or undeformed state adapts to a circular or round clamping profile so that the tool shaft can be easily inserted in the opening of the safety cap.

When the finger pressure on the two opposing narrow walls is released or removed, the clamping profile of the safety cap reverts in the direction of its undeformed shape so that the inside surface of the wide walls of the clamping part of the safety cap form clamping contact with the outside surface of the tool shaft, which is engaged there and held by clamping.

It is thus possible for the first time to clamp tool shafts having geometries and diameters that differ over a wide range.

According to the presently disclosed invention, tool shafts in the diameter range between 5 and 10 mm can now be accommodated with a clamping effect by a clamping opening, that forms a diameter or major dimension of 10 mm in the width, for example, and forms a diameter or minor dimension of 5 mm at an angle of 90° to the narrow side.

The advantage of this novel clamping method is that, due to the elastic widening of the clamping opening, the clamping cap can now accommodate a tool shaft assembled with tips, without great friction and without undue risk that the tool shaft will damage the inside walls of the safety cap and dislodge particles.

Thus, while the tool shaft is not yet completely inserted into the safety cap, the safety cap is held open by finger pressure, so that the clamping profile is thereby opened. With the clamping profile open, the tool shaft is inserted together with the tip and blades optionally also disposed thereon without the tip and the blades frictionally engaging the inside walls of the safety cap. When finger pressure is removed from the narrow sides of the safety cap, the safety cap resiliently, elastically returns in the direction of its original, undeformed shape with elastic deformation, so that the wide walls of the safety cap are in clamping contact with the outside circumference or outer surface of the tool shaft, without dislodging any particles from the safety cap.

For removal of the tool shaft, the opposite procedure is performed, which means that, now again, the clamping opening is opened by finger pressure so that the tool shaft can be pulled out of the interior of the safety cap without friction and without entrainment of particles.

The elasticity of the clamping part of the safety cap is achieved according to the invention by the slot disposed in the vicinity of the front wall. Such slot decouples the elasticity of the clamping part of the safety cap from the less elastic or less deformable bottom wall (front wall) of the safety cap, thereby achieving an excellent deformability of the clamping part of the safety cap, while the front wall itself no longer participates in the deformation.

The tool shaft is thus clamped only by the clamping action of the wide walls of the safety cap, so that the narrow walls themselves do not participate in the clamping.

Instead, there is a free position in the region of the narrow walls in the transitional region to the adjacent wide wall in each case. This free position is variable according to the diameter of the shaft to be covered and thus affords diameter compensation.

The front wall or the diameter of the front wall above the slot is consequently always greater than the largest diameter of the tool shaft to be accommodated.

The present invention relates to safety caps of a general type, wherein, preferably, a transparent or at least translucent plastic that ensures good visibility of the tool shape inserted into the safety cap is used. The plastic material may be a permanently elastic plastic such as PP, PE, TPE and similar plastics.

In a preferred embodiment, a slot is present in the region of each of the opposing wide walls. The two slots are disposed so they are flush or oppositely disposed on the safety cap from one another. This achieves reliable decoupling of the front wall because the front wall, due to its lower elasticity, no longer participates in the deformation of the safety cap itself, even in the region of the lower clamping part.

If there were no slots oppositely disposed or flush with one another in the wide walls, the lack of elasticity of the front wall would limit the elastic deformation of the adjacent wide walls. The range of tool diameters that the safety cap could accommodate would therefore be more limited.

In an embodiment, the slots disposed relative to one another are approximately rectangular in shape and are aligned with their longitudinal extent oriented perpendicular to the longitudinal axis of the safety cap.

However, the invention is not limited to this. The slots may have alternative shapes; for example, they may also have a round cross section or a polygonal cross section or they may be designed as polygons in general.

The term "slot" as used here means that the width of the slot is much smaller than the length of the slot.

In the case of a safety cap having a wide wall with a length of 10 mm, for example, the length of the slot is then 7 mm, for example, so that webs which are each 1.5 mm wide are then attached in the outside region of the slots. The slot width here is approx. 2 mm.

These are merely examples of dimensions which can be varied within wide limits. This should give only an approximate overview of how the slot geometry relates to the other dimensions of the safety cap.

The invention is not limited to a slot running transversely in the region beneath the front wall of the safety cap. The slot may also run in the longitudinal direction of the safety cap. In another embodiment, it is also not necessary for the slots that are opposite one another and flush with one another to be disposed in the wide walls of the safety cap.

In another embodiment, the wide walls themselves do not each have a slot passing through them but instead the adjacent narrower walls have the slots.

It is also possible, depending on the embodiment of the safety cap and as needed, that the slots are designed in the form of windows to ensure, as another advantage, good visibility of a tool shaft having a tip or a blade attached thereto and inserted into the interior of the safety cap.

In a preferred embodiment of the invention, it is provided that the front wall of the safety cap (bottom wall) is designed to be approximately planar. However, the invention is not limited to this. The front wall may also be designed with a camber or it may additionally have an internal cone or it may be designed to be conical itself to ensure additional centering of a tool shaft provided with a tip in the interior of the safety cap.

In another embodiment of the invention, it is possible to provide for additional perforations in the form of holes, for example, or other round or non-round recesses to be provided in the region of the wide walls and/or in the region of the narrower walls. These recesses may ensure that, when a medical instrument is accommodated in the safety cap, the medical instrument may itself be subjected to a sterilization process together with the safety cap, which thus ensures that the sterilization medium will also pass fully over the medical tool accommodated in the safety cap. These recesses may also be used for the inflow and outflow of other cleaning media.

The subject matter of the present invention is derived not only from the subject matter of the individual patent claims but also from the combination of the individual patent claims with one another.

All the information and features disclosed in the documents, including the abstract, and in particular the three-dimensional embodiment depicted in the drawings are hereby claimed as essential to the invention inasmuch as they are novel individually or in any combination in comparison with the prior art.

BRIEF DESCRIPTION OF THE DRAWINGS

The invention is explained in greater detail below on the basis of drawings, which illustrate just one means of embodiment. Additional features that are essential to the invention and advantages of the invention can be derived from these drawings and the description thereof. They show:

FIG. 1 shows a side view of a safety cap.

FIG. 2 shows the view of the safety cap according to FIG. 1 rotated by 90°.

FIG. 3 shows a side view of the clamping opening of the safety cap in a deformed state and in an undeformed state.

FIG. 4 shows the end view of the same clamping opening according to FIG. 3 in a deformed state and in an undeformed state.

FIG. 5 shows a section according to line V-V in FIG. 2.

FIG. 6 shows the top view of the front wall of the safety cap.

[12*a*: large tool shaft, 12*b*: small tool shaft]

Figures 10, 11, 12A, 12B, 13A, 13B, 14A, 14B:
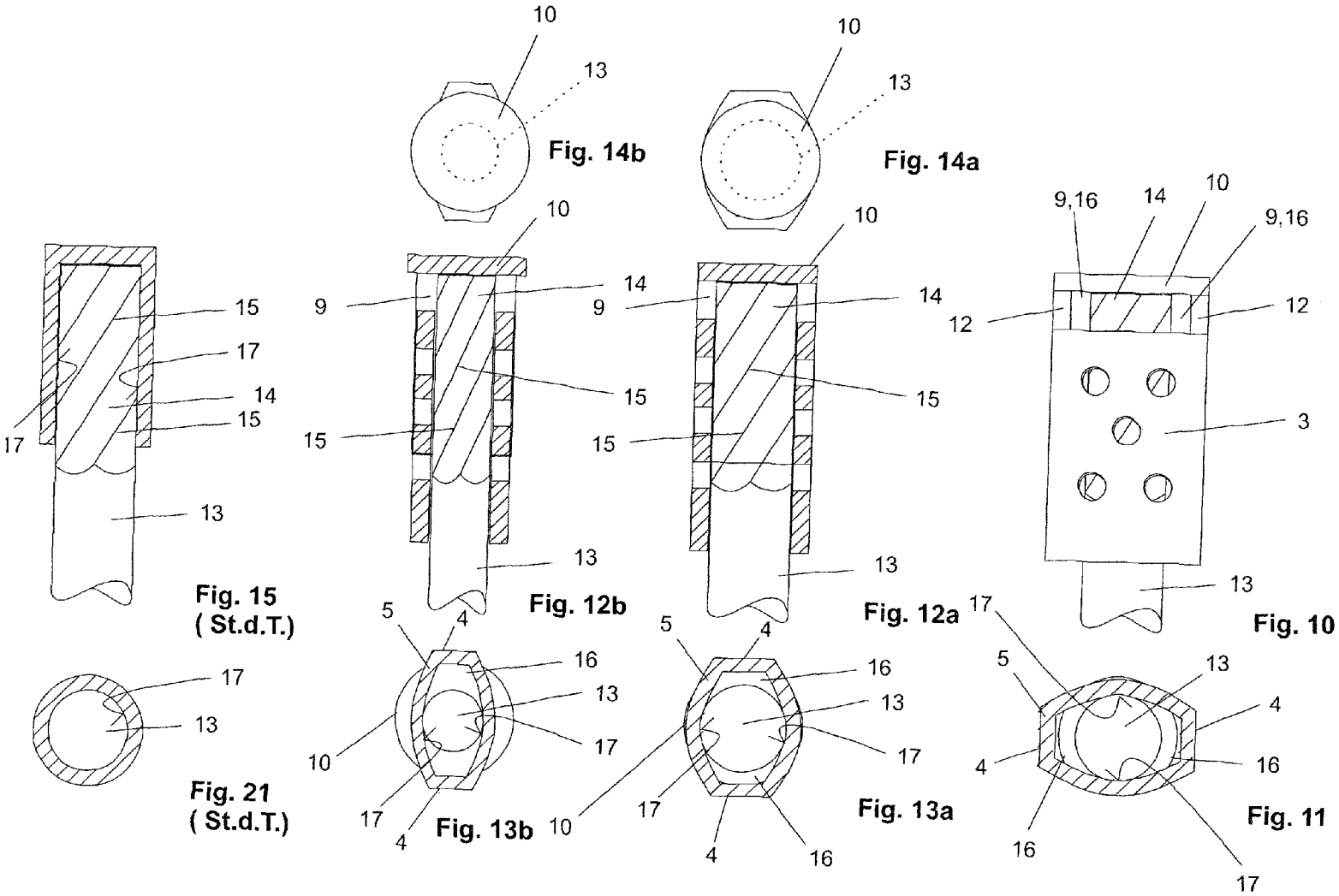
FIG. 10 shows the side view of the safety cap with an inserted tool shaft.
FIG. 11 shows the front view of FIG. 10.
FIGS. 12*a* and 12*b* show the view according to FIG. 10, rotated by 90°, in cross section.

FIGS. 13*a* and 13*b* show the front view of FIG. 12*a* and FIG. 12*b*.

FIGS. 14*a* and 14*b* show the top view of the upper front wall according to FIG. 12*a* and FIG. 12*b*.

FIG. 15 shows a cup-shaped safety cap with a low intrinsic elasticity according to the prior art.

Figure 16:
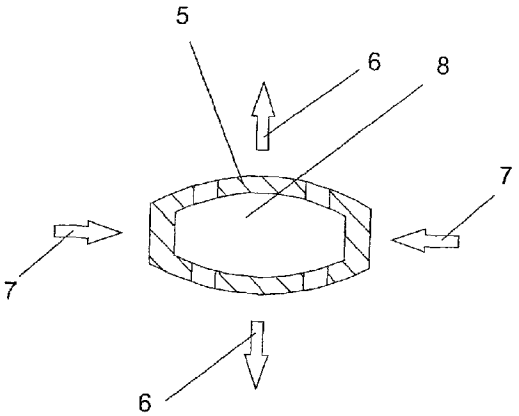

FIG. 16 shows a diagram of the profile shape of the clamping opening in an unclamped state.

Figure 17:
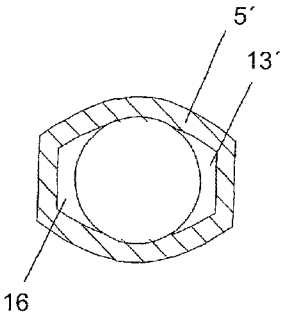

FIG. 17 shows a diagram of the profile shape of the clamping opening in clamping a tool shaft having a first diameter.

Figure 18:
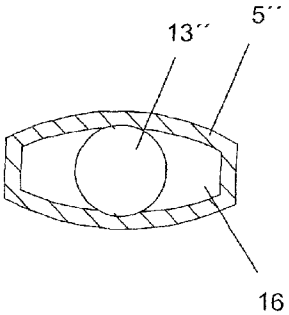

FIG. 18 shows the same clamping opening in clamping a tool shaft having a smaller diameter.

Figure 19:
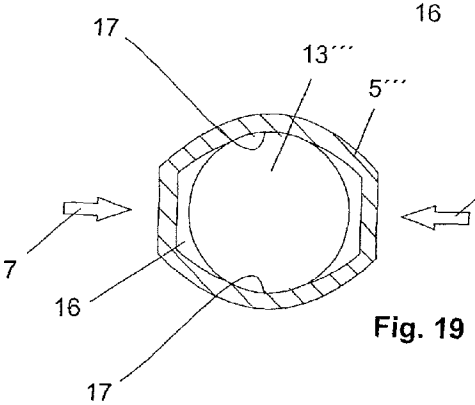

FIG. 19 shows the same clamping opening in clamping a tool shaft having a larger diameter.

Figure 20:
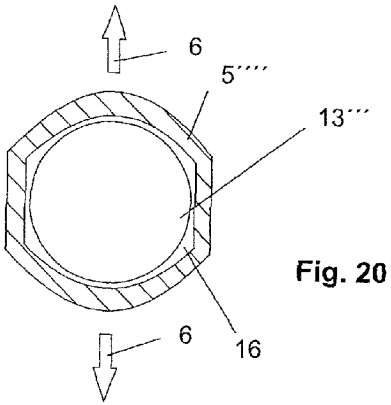

FIG. 20 shows the removal position of the clamping opening when the elasticity of the clamping walls is counteracted by finger pressure and the tool shaft can be removed from the clamping opening without friction.

FIG. 21 shows the front view of FIG. 15.

DESCRIPTION OF A PRESENTLY PREFERRED EMBODIMENT

The figures show in general a safety cap 1 made of an elastomer plastic material having a permanent intrinsic elasticity. The safety cap is designed to be approximately cup-shaped but has a profile shape that deviates from the circular or rotationally symmetrical cross section in FIGS. 3, 4, 7 and 8 and thus forms a clamping opening 8 that deviates from the round cross section and is approximately elliptical or rectangular in shape. In any case, the clamping opening is designed so that the wide wall 3 is much longer in its length than the length of the narrow wall 4.

Figure 7:
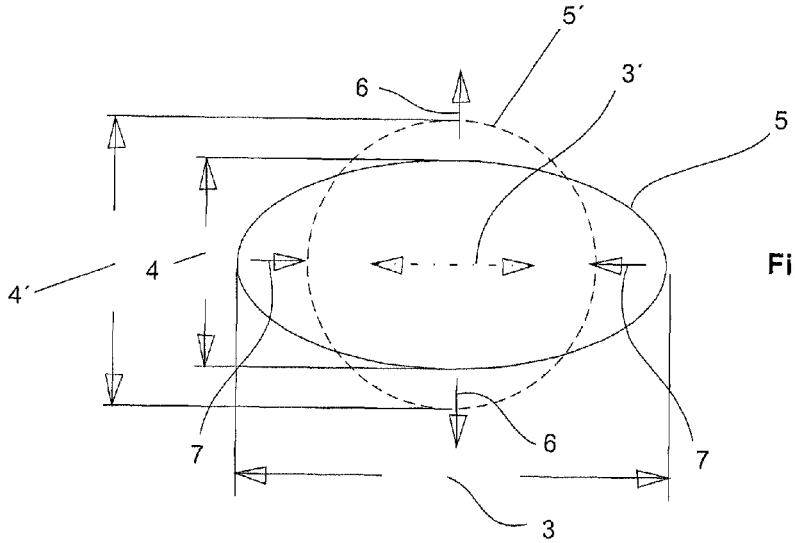
FIG. 7 shows schematically the size ratios of the clamping opening in the stressed or deformed and unstressed or undeformed state.

FIG. 7 shows how the narrow walls have an approximately round cross section under elastic deformation due to finger pressure on the two opposing narrow walls 4 in the direction of the arrow 7. At the same time, the length of the wide walls 3 or major cross-section dimension of clamping opening 8 is shortened because the wide walls 3 are directed radially outward in the direction of the arrow 6, while the narrow walls 4 or minor cross-section dimension of clamping opening 8 are deformed radially inward. There is thus a transition from the clamping profile 5 to the approximately round clamping profile 5'.

The major cross-sectional dimension 3 of clamping opening 8 which is longer and was formed previously, is thus converted into the shorter dimension 3' of clamping opening 8 under elastic deformation, while the shorter narrow wall or minor cross-section dimension 4 is converted into a longer dimension 4' in the clamping state.

Consequently, the safety cap 1 according to the invention, as shown in FIGS. 1 through 5, comprises a lower clamping part 2 which forms said clamping profile 5, 5' having a clamping opening 8, 8'. Mutually opposing slots 9, which are preferably flush with one another and are preferably formed in the region of the respective wide wall 3 are arranged below the front wall 10 which terminates the cup-shaped hollow body of the safety cap 1 toward the top.

The transverse axis 19 running through the slot 9 lies transversely to the longitudinal axis 18 of the safety cap 1.

Figure 8:
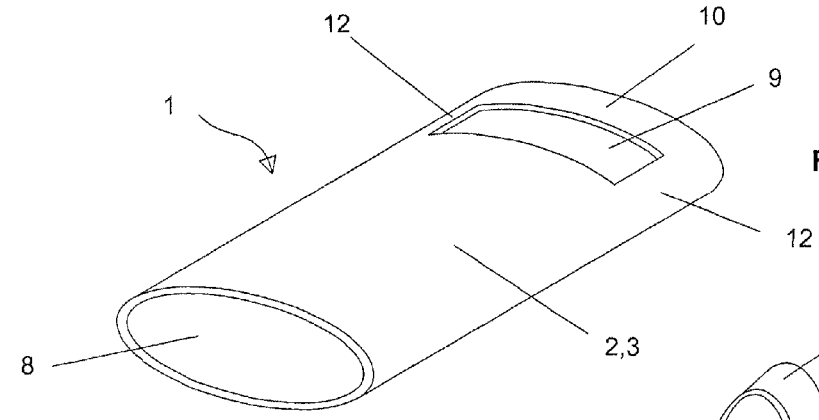
FIG. 8 shows a perspective side view of the safety cap according to the embodiment of FIGS. 1 through 6.

FIG. 8 also shows this schematically in a perspective diagram.

Figure 9:
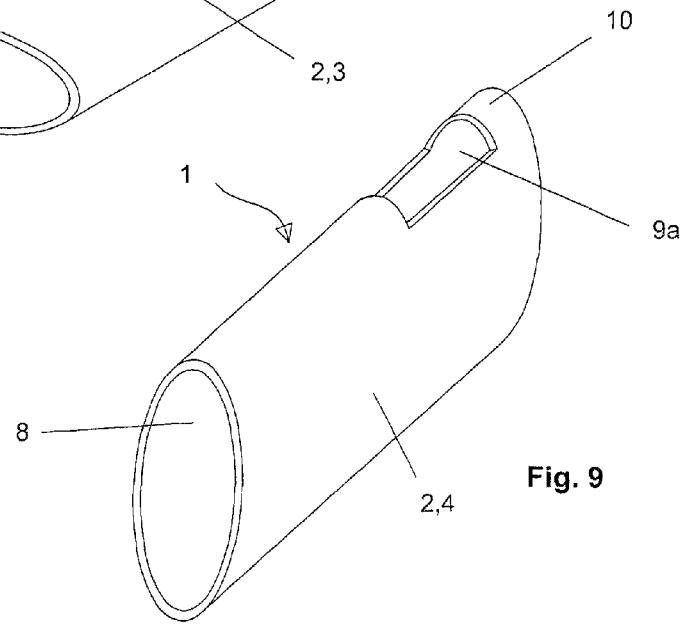
FIG. 9 shows an embodiment that has been modified in comparison with FIG. 8.

However, in another embodiment of the invention, it may also be provided that the longitudinal axis 19 through the slot 9 lies parallel to the longitudinal axis 18 of the safety cap 1. In another embodiment—depicted in FIG. 9—it may also be provided that the wide walls 3 are formed continuously up to the front wall 10 while the slots 9 are formed either in the transverse direction or in the longitudinal direction in the region of the opposing narrow walls 4. This is shown in FIG. 9.

It is important that a clamping part 2 that has an excellent diameter variability is formed below the slots 9 so that the clamping profile 5 can be converted to the clamping profile 5' and thus a plurality of shafts of different diameters can be chucked by clamping them without resulting in difficulties in extraction of a tool shaft 13 clamped in this way.

FIG. 5 also shows that it is preferable for recesses 11 which penetrate through the wide walls 3 to be provided at least in the region of the wide walls 3 to ensure that, when using sterilizable medical instruments, the sterilization medium will pass through the recesses 11 into the space of the safety cap 1 and thus into the clamping opening 8. Other cleaning media may also be supplied and removed through these recesses 11 to clean an object in the safety cap 1.

Furthermore, various cleaning techniques, such as cleaning with a brush, may also be performed through the recesses 11.

The length of the slots 9 is such that relatively narrow webs 12 which ensure a connection of the clamping part 2 to the upper front wall 10 in a one-piece material design are formed in the boundary region according to FIG. 2.

This ensures that the slots 9 decouple the clamping profile 5, 5' from the less elastic front wall 10, so that the wide and narrow walls 3, 4 achieve an excellent elasticity. The front wall 10 has at least the diameter of the tool or of the object.

FIGS. 10 through 20 show the use of a safety cap for clamping tool shafts 13 having diameters that vary greatly.

FIG. 11 shows that the tool shaft 13 is in contact with the inside of the wide walls 3 only in the region of the clamping surfaces 17 because lateral free positions 16, which vary according to the diameter of the tool shaft 13, are provided in the direction of each of the narrow walls 4.

This shows only that the tool shaft 13 has additional blades 15 and optionally also has a tool tip 14 in the upper region, which may optionally also be designed to be conical.

It is important that the blades 15 are in contact with the clamping surfaces 17 by clamping only in the region of the wide walls 3 so that the clamping effect can be canceled by finger pressure in the direction of the arrows 7 according to FIG. 7 as illustrated in FIG. 16.

FIG. 15 shows an arrangement according to the prior art, where it can be seen that a safety cap has a rotationally symmetrical cross section, so that the blades 15 of a tool shaft 13 clamped there are in clamping contact with the inside wall of the safety cap on all sides along the complete circumference. At times when the shaft 13 is being withdrawn from the safety cap, the blades 15 may scrape particles off of the clamping surfaces 17 and entrain them in a deleterious manner during extraction from the safety cap. FIG. 21 shows a top view of the rotationally symmetrical cross section according to FIG. 15.

This is avoided with the invention as will be further explained below with reference to FIGS. 16 through 20.

FIG. 16 shows that the clamping opening 8 can be widened in the direction of the arrow 7 by finger pressure or by a suitable automated packaging device, so that the wide walls 3 yield in the direction of the arrow 6 at the same time.

Thus according to FIG. 17 the clamping profile 5 for clamping a shaft 13' may be converted to a first clamping profile 5' so that there is reliable clamping of such a tool shaft 13'.

However, if a much smaller tool shaft 13" is inserted into the clamping profile 5" according to FIG. 18, the lateral free positions 16 become larger but nevertheless there is still reliable clamping in the region of the mutually opposing wide walls 3.

However, if a tool shaft 13''' having a relatively large diameter is inserted according to FIG. 19, this is also reliably held on the clamping surfaces 17 in the region of the mutually opposite wide walls 3 and a further clamping profile 5''' is thereby additionally formed and also ensures reliable clamping of even a tool shaft 13''' of large dimensions.

As shown in FIG. 20, if it is desired to extract the tool shaft 13''' from the clamping opening 8 having the clamping profile 5'''', then by finger pressure in the direction of the arrow 7, or by pressure of a suitable device with which automatic packaging of tool shafts is possible, the clamping profile is converted to the open profile 5''''. FIG. 20 shows that the shaft becomes free on all sides and therefore there is no longer a risk that it will dislodge particles from the inside walls of the safety cap with its outside circumference and entrain them in an unacceptable manner.

Thus, an advantage of the invention is that it is now possible for the first time to clamp tool shafts 13, 13', 13", 13''' having extremely different diameters and to always ensure that no material will be scraped or dislodged from the inside wall of the safety cap 1 by the tool shaft 13 and entrained with the tool shaft when the tool shaft 13 is pulled out of the safety cap 1.

LEGEND TO THE DRAWINGS

1 Safety cap
2 Clamping part
3 Wide wall 3'
4 Narrow wall 4'
5 Clamping profile 5', 5", 5''', 5''''
6 Direction of arrow
7 Direction of arrow
8 Clamping opening 8'
9 Slot
10 Front wall
11 Recess
12 Web
13 Tool shaft 13', 13", 13'''
14 Tool tip
15 Blade
16 Free position
17 Clamping surface
18 Longitudinal axis
19 Transverse axis
20 Direction of arrow

What is claimed is:

1. A flexible safety cap for accommodating a selected one of a plurality of objects, each of which have a different diameter or different geometry, said flexible safety cap comprising:

a terminating front wall; and a clamping part having one end that is connected to said terminating front wall and that defines a clamping opening on the opposite end of said flexible safety cap from said terminating front wall, said clamping part having at least one dynamic, non-circular clamping profile that forms a clamping connection between the outside perimeter of the selected object and an inside wall of the clamping part at times when the object is held in said flexible safety cap, said clamping part having at least one slot that is located adjacent said terminating front wall and that penetrates through the wall of the clamping part, said clamping part including a wide wall and at least two opposing narrow walls, the dimension of the wide wall as measured along the perimeter of said clamping opening being longer than the dimension of either of said narrow walls as measured along the perimeter of said clamping opening, such that said clamping profile defines a minor dimension that widens elastically in response to pressure directed against the outside of said at least two opposing narrow walls.

2. The flexible safety cap according to claim 1 wherein said clamping profile has a cross-section that is elliptical or rectangular or acute-angled in shape.

3. The flexible safety cap according to claim 1 wherein the slot is defined by an edge with a shape that is elliptical, rectangular, round or polygonal.

4. The flexible safety cap according to claim 1 wherein said safety cap has a longitudinal axis and wherein said slot has a major axis that is oriented at an angle with respect to the longitudinal axis of the safety cap.

5. The flexible safety cap according to claim 1 wherein said cap includes at least two wide walls and wherein the selected object is held by the clamping effect of the inside surface of said wide walls.

6. The flexible safety cap according to claim 1 wherein the diameter of the front wall is larger than the largest diameter of a selected object to be accommodated in said flexible safety cap.

7. The flexible safety cap according to claim 1 wherein recesses are included in said clamping part, said recesses being useful for: cleaning said selected object in the region of the narrow walls; supplying and removing a cleaning medium; or performing various cleaning techniques.

8. The flexible safety cap according to claim 1 wherein said slots have a length such that webs are formed in the boundary region of said slots, said webs establishing a one-piece material connection of the clamping part to the front wall.

9. A flexible safety cap that is adapted to receive an object that is selected from a group of objects that define different outer perimeters, said flexible safety cap comprising:

a terminating front wall;

at least two webs that are connected to said terminating front wall, said webs being separated by at least one slot between said webs; and an elastic clamping part that defines an inside wall and a first end that is connected to said webs, said clamping part also have a second end that is located oppositely from said first end that is connected to said webs, said second end defining a clamping opening having a major cross-section dimension and a minor cross-section dimension, said clamping part being elastically responsive to pressure against the outside of said clamping part in the direction of said major cross-section dimension to move said clamping part to a deformed position in which the major dimension of said clamping opening is decreased and the minor dimension of said clamping opening is increased so that, at times when said clamping part is in said deformed position, said resilient clamping part can receive said object in said clamping opening, and at times when said pressure against the outside of said clamping part in the direction of said major cross-section dimension is relaxed, the clamping opening of said elastic clamping part resiliently moves from said deformed position to a clamping position having a lengthened major dimension and a shortened minor dimension with the inside wall of the clamping part adjacent the shortened minor dimension contacting the outside perimeter of the object.

10. The flexible safety cap according to claim 9 wherein, at times when no pressure is applied to the outside surface of said elastic clamping part, said major cross-section dimension is greater than said minor cross-section dimension.

11. The flexible safety cap according to claim 9 wherein the outer surface of said elastic clamping part defines at least two wide walls that are interspaced between at least two narrow walls, wherein the peripheral length of said wide walls is longer than the peripheral length of said narrow walls.

12. The flexible safety cap according to claim 9 wherein the cross-sectional shape of said clamping part is elliptical or rectangular or acute-angled.

13. The flexible safety cap according to claim 9 wherein said slot defines an elliptical opening, a rectangular opening, a round opening or a polygonal opening.

14. The flexible safety cap according to claim 9 wherein said flexible safety cap is centered on a longitudinal axis and wherein said slot has a major longitudinal axis that is oriented at an angle with respect to the longitudinal axis of said safety cap.

15. The flexible safety cap according to claim 11 wherein said object is held inside said elastic clamping part by the clamping effect of the inside of said wide walls.

16. The flexible safety cap according to claim 9 wherein the diameter of said front wall is larger than the largest diameter of an object that is selected to be clamped in said clamping part.

17. The flexible safety cap according to claim 11 wherein the clamping opening of said clamping part is elastically widened in the direction of its minor cross-sectional axis in response to pressure to the opposing narrow walls.

18. The flexible safety cap according to claim 11 wherein the inside surface of said elastic clamping profile includes additional recesses that clean the object in the region of the narrow walls by supplying or removing a cleaning medium or performing various cleaning techniques.

19. The flexible safety cap according to claim 9 wherein said webs establish a one-piece material connection between said elastic clamping part and said front wall, and wherein said slots have a length such that said webs are located in the boundary region of said slots.

* * * * *